US005701359A

United States Patent [19]

Guenther et al.

[11] Patent Number: 5,701,359

[45] Date of Patent: Dec. 23, 1997

[54] FLAT-PANEL SPEAKER

[75] Inventors: Edward W. Guenther, Paradise Valley; Stephen Leigh, Scottsdale, both of Ariz.

[73] Assignee: Precision Power, Phoenix, Ariz.

[21] Appl. No.: 418,268

[22] Filed: Apr. 6, 1995

[51] Int. Cl.[6] ..... H04R 25/00

[52] U.S. Cl. ..... 381/203; 381/202; 181/157; 181/169

[58] Field of Search ..... 381/202, 203; 181/157, 163, 169

[56] References Cited

U.S. PATENT DOCUMENTS

| | | | |
|---|---|---|---|
| 3,347,335 | 10/1967 | Watters | 181/0.5 |
| 4,221,773 | 9/1980 | Tsukagoshi et al. | 423/445 |
| 4,291,781 | 9/1981 | Niguchi et al. | 181/169 |
| 4,410,768 | 10/1983 | Nakamura et al. | 181/170 |
| 4,517,416 | 5/1985 | Goossens | 179/115.5 PS |
| 4,562,899 | 1/1986 | Nakamura | 181/169 |
| 4,772,513 | 9/1988 | Sakamoto et al. | 428/408 |
| 5,206,466 | 4/1993 | Inamiya | 181/169 |

FOREIGN PATENT DOCUMENTS

| | | |
|---|---|---|
| 2450020 | 9/1980 | France . |
| 54-12823 | 1/1979 | Japan . |
| 54-39625 | 3/1979 | Japan . |
| 55-3240 | 1/1980 | Japan . |
| 55-46664 | 4/1980 | Japan . |
| 56-125193 | 10/1981 | Japan . |
| 57-30496 | 2/1982 | Japan . |
| 57-30498 | 2/1982 | Japan . |
| 57-152297 | 9/1982 | Japan . |
| 59-28798 | 2/1984 | Japan . |
| 59-86995 | 5/1984 | Japan . |
| 60-152198 | 8/1985 | Japan . |
| 61-146099 | 7/1986 | Japan . |
| 61-210796 | 9/1986 | Japan . |
| 61-236298 | 10/1986 | Japan . |
| 61-244195 | 10/1986 | Japan . |
| 62-244194 | 10/1986 | Japan . |
| 62-56097 | 3/1987 | Japan . |
| 62-163494 | 7/1987 | Japan . |
| 62-163495 | 7/1987 | Japan . |
| 62-245900 | 10/1987 | Japan . |
| 63-54100 | 3/1988 | Japan . |
| 63-131800 | 6/1988 | Japan . |
| 63-138900 | 6/1988 | Japan . |
| 63-215200 | 9/1988 | Japan . |
| 63-226197 | 9/1988 | Japan . |
| 63-283299 | 11/1988 | Japan . |
| 2-148999 | 6/1990 | Japan . |
| 2-170797 | 7/1990 | Japan . |
| 2-233098 | 9/1990 | Japan . |
| 2-305095 | 12/1990 | Japan . |
| 5-68297 | 3/1993 | Japan . |
| 2225510 | 5/1990 | United Kingdom . |

OTHER PUBLICATIONS

Beranek, *Acoustics*, (Table of Contents, Chapters 1, 3, and 7, American Institute of Physics, 1954).

Olson et al., "Recent Developments in Direct–Radiator High–Fidelity Loudspeakers," *An Anthology of Articles on Loudspeakers from the pages of the Journal of the Audio Engineering Society*, pp. 7–15 (vol. 1–vol. 25, 1953–1977).

(List continued on next page.)

*Primary Examiner*—Curtis Kuntz
*Assistant Examiner*—Rexford N. Barnie
*Attorney, Agent, or Firm*—Steven G. Lisa

[57] ABSTRACT

A composite loudspeaker diaphragm is disclosed having first and second substantially flat carbon fiber skins, and a honeycomb core sandwiched between the first and second carbon skins. In a preferred form, each carbon fiber skin comprises a sheet formed of primarily unidirectional carbon filaments bound together by an epoxy resin. In the preferred embodiment, the honeycomb core is formed of nomex, and is glued with epoxy to the first and second carbon skins, and then heated. The sandwich diaphragm is manufactured so that the direction of the carbon fibers of the cross plies of each outer skin are out of phase relative to each other, preferrably in the range of approximately ninety degrees. The improved diaphragm is used in an flat-panel loudspeaker system having improved performance at higher frequencies.

23 Claims, 4 Drawing Sheets

OTHER PUBLICATIONS

Janszen, "An Electrostatic Loudspeaker Development," *An Anthology of Articles on Loudspeakers from the pages of the Journal of the Audio Engineering Society*, pp. 21–24 (vol. 1–vol. 25, 1953–1977).

Olson, "Analysis of the Effects of Nonlinear Elements Upon the Performance of a Back–Enclosed, Direct Radiator Loudspeaker Mechanism," *An Anthology of Articles on Loudspeakers from the pages of the Jorunal of the Audio Engineering Society*, pp. 77–83 (vol. 1–vol. 25, 1953–1977).

Barlow, "The Development of a Sandwich–Construction Loudspeaker System," *An Anthology of Articles on Loudspeakers from the pages of the Journal of the Audio Engineering Society*, pp. 159–171 (vol. 1–vol. 25, 1953–1977).

Frankort, "Vibration Patterns and Radiation Behavior of Loudspeaker Cones," *An Anthology of Articles on Loudspeakers from the Pages of the Journal of the Audio Engineering Society*, pp. 16–29 (vol. 26–vol. 31, 1978–1983).

Shindo et al., "Effect of Voice–Coil and Surround on Vibration and Sound Pressure Response of Loudspeaker Cones," *An Anthology of Articles on Loudspeakers from the Pages of the Journal of the Audio Engineering Society*, pp. 169–178 (vol. 26–vol. 31, 1978–1983).

Yamamoto et al., "High–Fidelity Loudspeakers with Boronized Titanium Diaphragms," *An Anthology of Articles on Loudspeakers from the Pages of the Journal of the Audio Engineering Society*, pp. 198–203 (vol. 26–vol. 31, 1978–1983).

Gander, "Moving–Coil Loudspeaker Topology as an Indicator of Linear Excursion Capability," *An Anthology of Articles on Loudspeakers from the Pages of the Journal of the Audio Engineering Society*, pp. 204–220 (vol. 26–vol. 31, 1978–1983).

Sakamoto et al., "Loudspeaker with Honeycomb Disk Diaphragm," *An Anthology of Articles on Loudspeakers from the Pages of the Journal of the Audio Engineering Society*, pp. 263–271 (vol. 26–vol. 31, 1978–1983).

Tsukagoshi et al., "Polymer–Graphite Composite Loudspeaker Diaphragm," *An Anthology of Articles on Loudspeakers from the Pages of the Journal of the Audio Engineering Society*, pp. 272–277 (vol. 26–vol. 31, 1978–1983).

Nakzono et al., "Coaxial Flat–Plane Loudspeaker with Polymer–Graphite Honeycomb Sandwich Plate Diaphragm," *An Anthology of Articles on Loudspeakers from the Pages of the Journal of the Audio Engineering Society*, pp. 278–285 (vol. 26–vol. 31, 1978–1983).

Niguchi et al., "Reinforced Olefin Polymer Diaphram for Loudspeakers," *An Anthology of Articles on Loudspeakers from the Pages of the Journal of the Audio Engineering Society*, pp. 286–291 (vol. 26–vol. 31, 1978–1983).

Suzuki et al., "Computerized Analysis and Observation of the Vibration Modes of a Loudspeaker Cone," *An Anthology of Articles on Loudspeakers from the Pages of the Journal of the Audio Engineering Society*, pp. 278–285 (vol. 26–vol. 31, 1978–1983).

"Sandwich Panel Review . . . Part 1," *The M.C. Gill Doorway* (vol. 28, No. 2, Spring 1991).

"Sandwich Panel Review . . . Part 2," *The M.C. Gill Doorway* (vol. 28, No. 3, Summer 1991).

"Sandwich Panel Review . . . Part 3," *The M.C. Gill Doorway* (vol. 28, No. 4, Fall 1991).

"Sandwich Panel Review . . . Part 4," *The M.C. Gill Doorway* (vol. 29, No. 1, Winter 1992).

Olson, *Acoustical Engineering*, Table of Contents, Chapter 6 (1991).

FLAT-PANEL SPEAKER

FIELD OF THE INVENTION

This invention relates to the field of loudspeakers, and more specifically, to loudspeakers using improved flat diaphragms having a composite structure comprised of a honeycomb core sandwiched between outer carbon fiber skins. The novel flat diaphragm exhibits greatly improved performance due to its increased section modulus per unit weight.

BACKGROUND OF THE INVENTION

The structure, electronics, and performance characteristics of the common loudspeaker are well documented in the following texts and anthologies: *Acoustical Engineering*, Harry F. Olson, Ph.D., Professional Audio Journals, Inc., Philadelphia, Pa. (1991, Library of Congress Catalog Card No. 91-075297); *Acoustics*, Leo Beranek, American Institute of Physics, New York, N.Y. (1986, Library of Congress Catalog Card No. 86-70671); *Loudspeakers, An anthology of articles on loudspeakers from the pages of the Journal of the Audio Engineering Society* Vol. 1–Vol. 25 (1953–1977), 2nd Edition, Audio Engineering Society, Inc., New York, N.Y. (1980, Library of Congress Catalog Card No. 80-53465)(referred to below as "Anthology I"); and *Loudspeakers, An anthology of articles on loudspeakers from the pages of the Journal of the Audio Engineering Society* Vol. 26–Vol. 31 (1978–1983), Audio Engineering Society, Inc., New York, N.Y. (1984, Library of Congress Catalog Card No. 78-61479)(referred to below as "Anthology II"), each of which is incorporated herein by reference.

As discussed throughout the above-identified literature, the conical diaphragm is one of the most common forms of loudspeakers and is typically manufactured of fabric or plastic. It is generally considered the weakest link in the audio reproduction system.

More specifically, the audible sound spectrum contains widely different frequencies in the range of about 16 Hz to 20,000 Hz, and when alternating currents of those frequencies are applied to the common conical loudspeaker, the diaphragm will vibrate in different modes of lower and higher order. At lower frequencies, the conical diaphragm vibrates as relatively rigid body, and correspondingly, distortion remains low. However, the common conical diaphragm is not rigid enough to withstand the inertia forces that occur at higher frequencies. As a result, when higher frequency audio signals are applied to the common conical diaphragm, it starts to vibrate not as one unit, but in parts, causing correspondingly increased distortion in reproduced sound. See "Vibration Patterns and Radiation Behavior of Loudspeaker Cones," F. J. M. Frankfort, reproduced in Anthology II at pp. 16–29, and "Computerized Analysis and Observation of the Vibration Modes of a Loudspeaker Cone," reproduced in Anthology II at pp. 301–309, for a more detailed discussion of those drawbacks.

Many design efforts have focused on increasing the rigidity of the common conical loudspeaker diaphragm. In that regard, it is known that the most desirable characteristics of materials used for the loudspeaker diaphragm are high modulus E, low density p, moderate internal loss and low overall weight. A large value of the ratio E/p is desirable to extend the high frequency limit and to reduce harmonic distortion.

In one application, boronized titanium conical diaphragms were reportedly formed. See "High Fidelity Loudspeakers with Boronized Titanium Diaphragms," reproduced in Anthology II at p. 198–203. In a second approach, a polymer-graphite composite sheet was reportedly formed using graphite crystallite granules with polymer additives. The composite sheet was formed into various shapes for either low-frequency or high-frequency loudspeakers. See "Polymer-Graphite Composite Loudspeaker Diaphragm," reproduced at Anthology II at pp. 272–277.

It a third design, conical diaphragms were molded from olefin polymers and carbon fibers which were mixed together, treated and formed into a paper, which was then heated. In accordance with this approach, for larger diaphragms, the reinforced polymer material was applied as a sandwich structure, having the reinforced polymer sheets as the two surface materials, and an organic foaming sheet as the core. See "Reinforced Olefin Polymer Diaphragm for Loudspeakers," reproduced in Anthology II, at pp. 286–291. In a fourth application, conical loudspeakers were formed of sandwich construction consisting of aluminum outer skins with expanded polystyrene cores. See "The Development of a Sandwich-Construction Loudspeaker System," reproduced in Anthology I, at pp. 159–171. In this last article, it is stated that honeycomb aluminum or impregnated paper are frequently used as cores for sandwich construction in aircraft applications and could be used for flat diaphragms, but that the conical design was preferred because of increased rigidity.

However, it is known that the common conical loudspeaker design, which was adopted due to its increased rigidity as compared to other shape diaphragms, has additional drawbacks. Most importantly, a small apex angle for a conical diaphragm is necessary to achieve high resonance frequencies. However, a small apex angle also results in peaks and dips in the loudspeaker's frequency response. This problem has been addressed to some degree by using several conical loudspeakers of different diameters to cover the sound spectrum in multi-channel loudspeaker systems. However the problem still remains that the arrival times of sounds from the different conical loudspeakers vary depending on the number and relative apex angles of the different loudspeakers. Accordingly, in a fifth design approach, a coaxial flat-plane diaphragm was fabricated using a sandwich-type construction consisting of two polymer-composite sheets with an aluminum foil honeycomb core bonded in between. See "Coaxial Flat-Plane Loudspeaker with Polymer Graphite Honeycomb Sandwich Plate Diaphragm," reproduced in Anthology II, at pp. 278–285. In a sixth application, a honeycomb disk diaphragm is driven at the first nodal line of its resident mode, and is constructed using honeycomb sandwich plates in which the honeycomb core is axially symmetrical with a cell density distribution that increases toward the center of where the bending stress is most concentrated. See "Loudspeaker with Honeycomb Disk Diaphragm," reproduced in Anthology II, at pp. 263–271. In this last application, the sandwich disk is made entirely of aluminum foil.

In each of the above applications, either the construction techniques were difficult or expensive, making them impractical for efficient, large-scale commercial manufacture, the resulting diaphragm was relatively heavy, resulting in decreased performance, or the modulus to density ratio (E/p) was still too low, requiring the diaphragm to be driven at the first node of vibration, thereby further complicating manufacture. In addition, many of the designs continue to employ conical loudspeakers, which exhibit the "cavity effect" described above. Thus, the need still exists for an improved flat plane diaphragm having the desirable characteristics of high modulus E, low density p, moderate internal loss and low overall weight, and which is easily and efficiently mass produced at relatively low cost.

SUMMARY OF THE INVENTION

It is therefore an object of this invention to provide an improved flat-panel diaphragm for use in a loudspeaker system.

It is another object of the invention to provide an improved flat-panel diaphragm having high modulus E, low density p, moderate internal loss characteristics and low overall weight, but that can still be efficiently mass produced with readily available materials.

It is another object of the invention to provide an improved flat-panel diaphragm using lightweight but strong composite sandwich construction.

It is another object of the invention to provide a loudspeaker using an improved flat-panel diaphragm that provided flat, uniform frequency response with low distortion.

The above and other objects are achieved with a composite loudspeaker diaphragm having first and second substantially flat carbon fiber outer skins, and an aramid honeycomb core sandwiched between the first and second carbon outer skins. In a preferred form, each carbon fiber skin comprises a sheet formed of primarily unidirectional carbon filaments bound together by an epoxy resin. In the preferred embodiment, the honeycomb core is formed of nomex and is glued with epoxy to the first and second carbon skins. The overall sandwich is then heated to bond the individual materials together.

Even further improvements in performance are achieved by constructing the sandwich diaphragm so that the direction of the carbon fibers of the first skin are out of phase relative to the direction of the carbon fibers of the second skin, preferably at a phase angle of approximately ninety degrees. Still further improvements in performance are achieved by using a nomex honeycomb core that is thicker than each of the carbon fiber outer skins. For ease of manufacture, the nomex core can be manufactured of substantially uniform honeycomb cells.

The above and other objects are also achieved by an improved loudspeaker system using a flat-panel diaphragm for producing sound in response to varying audio signals. The loudspeaker system includes a voice coil assembly having a voice coil that carries a varying coil current in response to the varying audio signals generated by an audio source. A field structure in its common form includes a magnet and pole piece that generate an intense, symmetrical magnetic field in a gap proximate the voice coil. As a result, the voice coil assembly is driven in a reciprocating piston motion corresponding to the varying signal applied to the voice coil. A first or "inner" suspension system (sometimes also referred to as a "spider") is coupled to and movably supports the voice coil assembly throughout its reciprocating piston motion. The improved loudspeaker system includes an improved, substantially flat diaphragm coupled to the voice coil assembly and driven in a reciprocating piston motion corresponding to the motion of the voice coil assembly. The improved diaphragm is formed of a first carbon fiber skin, a second carbon fiber skin, and a nomex honeycomb core sandwiched between the first and second carbon fiber skins. A second or "outer" suspension system (sometimes also referred to as a "surround") is coupled to and movably supports the diaphragm throughout its reciprocating piston motion. A frame structure is coupled to and supports the first and second suspension systems and the field structure.

BRIEF DESCRIPTION OF THE DRAWINGS

The above and other objects, advantages and improvements are better understood with reference to the detailed figures and the description that follows, wherein like reference characters and numerals designate corresponding parts in the several views.

DETAILED DESCRIPTION OF THE PREFERRED EMBODIMENTS

Figure 1:
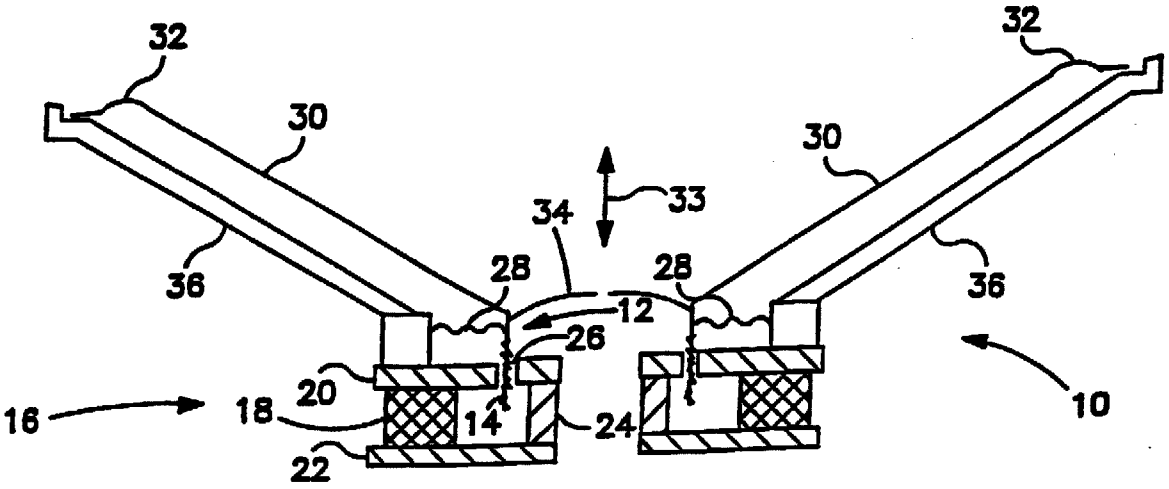
FIG. 1 is a cross-sectioned view of a conical, direct-radiating loudspeaker of conventional design.

FIG. 1 shows a side cross-section of a common dynamic moving coil, conical loudspeaker system 10. A voice coil assembly 12 includes a wound voice coil 14, which carries a varying current applied from an external source, such as, for example, an audio system (not shown). The loudspeaker system 10 is constructed so that the voice coil 14 is positioned within a constant magnetic field formed by a field structure 16. A typical field structure 16 includes a permanent magnet 18 coupled to a front plate 20 and a back plate 22. A pole piece 24 forms a gap 26 between it and the front plate 20. The coil 14 is positioned within the gap 26. The back plate 22, front plate 20, and pole piece 24 are generally made of a highly permeable material such as iron, which provides a path for the magnetic field of the magnet 18. The magnet 18 is typically made of ceramic/ferrite material and ring-shaped. An intense and constant magnetic field is formed in the gap 26, where the magnetic circuit is completed. The voice coil assembly 12 is movably supported by a first "inner" or "lower" suspension system 28, and is coupled to a conical diaphragm 30. The lower suspension system 28 is also commonly referred to as the "spider." The conical diaphragm 30 is typically manufactured of paper or plastic and is supported at its periphery by a second "outer" or "upper" suspension system 32. The upper suspension 32 is also commonly called a "surround." A dust cap 34 is usually included in the central area of the conical diaphragm 30. The field structure 16, the spider 28, and the surround 32 are connected to and supported by an appropriate frame structure 36.

In typical operation, when a current is applied to the voice coil 14, a corresponding electromagnetic field is produced at right angles to the flow of current and to the permanent magnetic field in the gap 26, causing a mechanical force that drives the voice coil assembly 12, and correspondingly the conical diaphragm 30, in a reciprocating piston-like motion indicated by the double-headed arrow 33. More specifically, the audio signal applied to the voice coil 14 is typically an alternating current in the form of a sine wave of varying frequency. The flow in the voice coil 14 of current in one direction on the positive half of the alternating cycle will cause a magnetic field of one polarity and will result in motion of the voice coil assembly 12 and attached diaphragm 30 in a first (e.g., outward) direction. When the current through the voice coil 14 reverses on the negative half of the cycle, the polarity of the magnetic field generated by the voice coil 14 reverses, and the motion of the voice coil assembly 12 and diaphragm 30 likewise reverses (e.g., inward). Thus, the voice coil assembly 12 and the attached conical diaphragm 30 are caused to move in a piston-like motion at frequencies corresponding to the frequency of the alternating current input to the voice coil 14.

As indicated in the literature discussed in the Background of the Invention, above, at increased frequencies, the typical cone 30 cannot efficiently overcome inertia forces, and the conical diaphragm 30 begins to vibrate not as a rigid body, but rather in parts, causing correspondingly increased distortion in reproduced sound. In addition, the conical form of the diaphragm 30 causes sound to reach a point at different times (the "cavity effect"). For example, because of the apex angle of the cone, sound waves emanating from the center of the conical diaphragm 30 typically take longer to reach a given point in the room than sound waves from the periphery of the conical diaphragm 30, thus further diminishing the performance. It is known that a flat diaphragm minimizes the "cavity effect." However, because the common conical shape of a diaphragm 30 of given material is substantially more rigid than a flat diaphragm of the same material, the conical shape is typically preferred commercially. Prior efforts to create flat-panel diaphragms with sufficient rigidity to avoid vibrational distortion and also to eliminate the unwanted "cavity effect" have failed to yield a easily manufacturable product having high modulus E, low density p, high internal loss, and low overall weight.

More specifically, as indicated in several of the articles discussed in the Background of the Invention, the airplane industry has for years used sandwiched honeycomb construction for floors and walls of airplanes. Typically, the skins and honeycomb cores of such structures were made of aluminum and other metals, and attempts to use such structures for flat-panel speakers proved unacceptable due to their high weight, low modulus to density ratios, and difficult and inefficient manufacturing techniques. Even prior flat diaphragms constructed of carbon fiber mesh outer skins and aluminum honeycomb or foam cores failed to exhibit desirable characteristics and ease of manufacture.

In recent years, however, much progress has been made in the development of carbon fiber and aramid (or nomex) honeycomb structures, particularly in connection with aircraft manufacturing. It has been found that recently available "carbon-nomex-carbon" sandwiched structures used in the aircraft industry also exhibit many of the desirable characteristics of high modulus, low density, high internal loss and ease of manufacture. As explained below, it has further been found that novel loudspeaker systems using flat-panel diaphragms formed from such recently developed and publicly available "carbon-nomex-carbon" sandwiched structures used in the aircraft industry exhibited greatly increased performance with minimal vibration-induced distortion and no "cavity effect." As will be explained, modifications to such publicly available structures can still further improve performance of the new flat-panel diaphragm.

Figure 2:
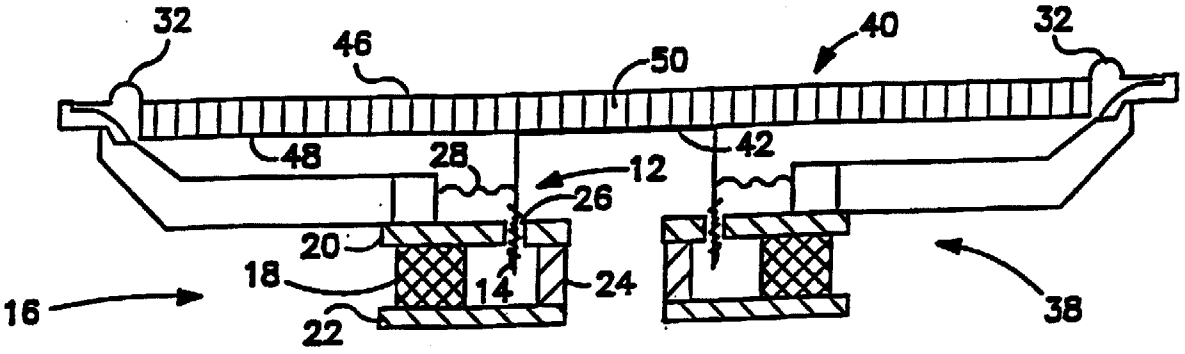
FIG. 2 is a cross-sectioned view of a direct-radiating loudspeaker system employing a flat-panel diaphragm of the present invention.

Shown in FIG. 2 is a novel loudspeaker system 38 employing an improved flat-panel diaphragm 40 fabricated from a "carbon-nomex-carbon" sandwich that exhibits the desirable properties of high modulus E, low density p, high internal loss, low overall weight, and importantly, ease of manufacture. The novel loudspeaker system 38 exhibits increased resistance to vibration, thereby reducing vibration-induced distortion at higher frequencies, has no negative "cavity effect" owing to the flat shape of the diaphragm 40, is low in overall weight, and further, has decreased overall height, allowing installation in smaller enclosures and tighter spaces. Additionally, the improved construction of the flat-panel diaphragm 40 is so strong as to be virtually indestructible when used in the loudspeaker environment.

The improved loudspeaker system 38 includes a field structure 16 which, for convenience, is depicted as similar to the structure shown in FIG. 1. However, any appropriate field structure can be used. The coil assembly 12 is attached at an upper portion 42 to the underside of the flat diaphragm 40. Any appropriate voice coil assembly can likewise be used. The flat diaphragm 40 is suspended within an appropriate frame 44 by a spider 28 and surround 32. Although lower 28 and upper 32 suspension systems are shown in FIG. 2, it is expressly noted that any appropriate single or multiple suspension system or method can be employed. As will be explained in further detail below, the flat diaphragm 40 is comprised of an upper carbon fiber skin 46, a lower carbon fiber skin 48, and a sandwiched honeycomb-cell nomex core 50. As with any standard loudspeaker system, the diaphragm 40 is driven in a piston-like motion by the magnetic force generated by the alternating current carried by coil 14 and the field structure 16. However because the improved "carbon-nomex-carbon" diaphragm 40 is flat, no "cavity effect" results. Further, because the improved diaphragm 40 has an exceptionally high modulus to density (E/p) ratio, high frequency performance is greatly enhanced over prior conical and flat-panel diaphragm loudspeakers.

Figure 3:
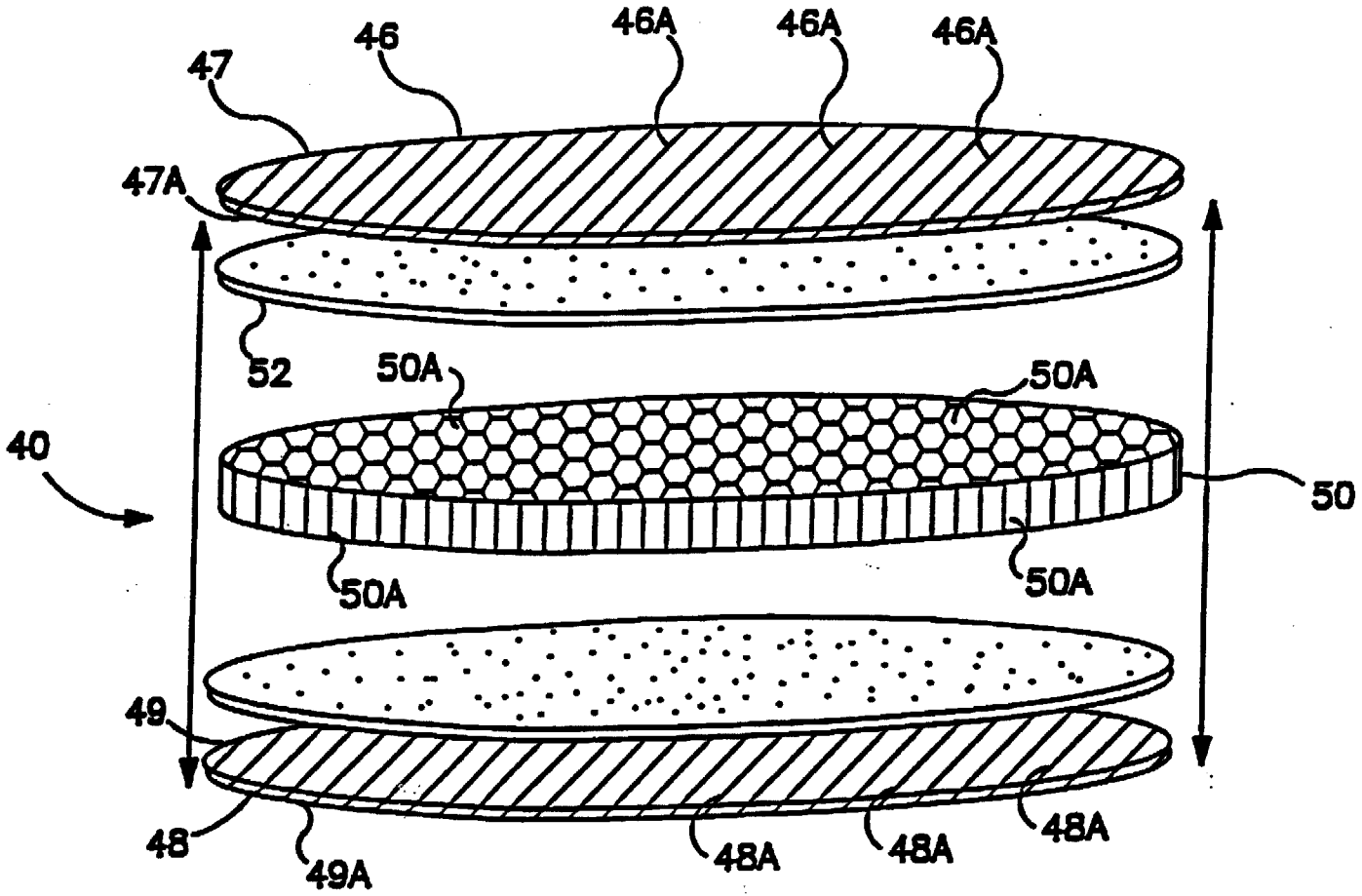
FIG. 3 is an exploded perspective view of the primary elements of a preferred form of the carbon-nomex-carbon sandwich loudspeaker diaphragm.
Figure 4:
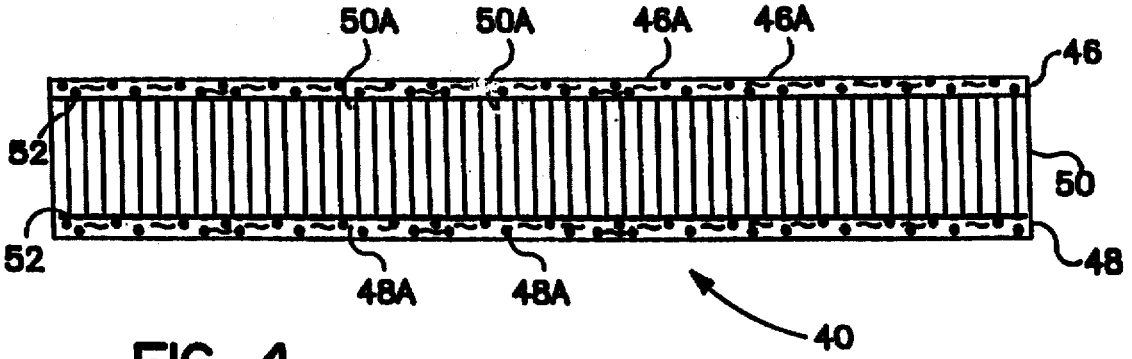
FIG. 4 is a cross-sectional view depicting the assembled structure of a flat-panel loudspeaker diaphragm shown in exploded form in FIG. 3.
Figure 5:
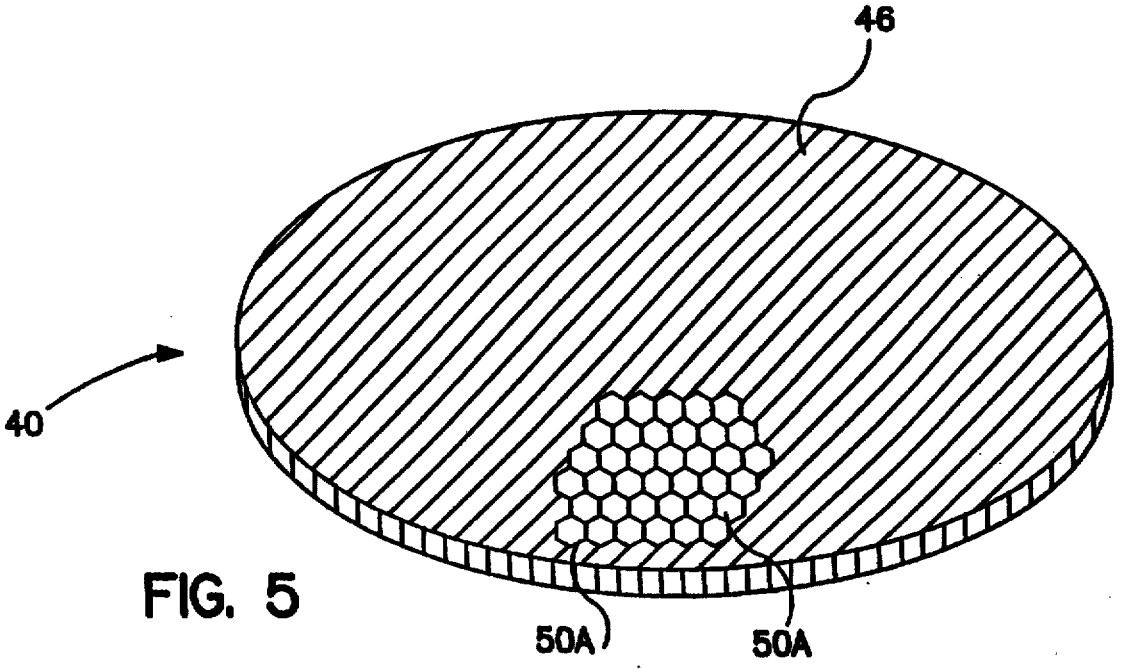
FIG. 5 is a top quarter view of a flat-panel loudspeaker diaphragm with a portion of the carbon-fiber top skin cut away to reveal the uniform honeycomb cell structure of a preferred form of the nomex core.

Shown in FIGS. 3, 4 and 5 are more detailed views of the flat-panel diaphragm 40 shown more generally in FIG. 2. The improved flat-panel diaphragm 40 is comprised of a first (or top) carbon fiber skin 46 and a second (or lower) carbon fiber skin 48. Sandwiched between the top and bottom carbon fiber skins 46 and 48 is a nomex honeycomb core 50. Glue or epoxy sheets 52 are applied to bond the nomex honeycomb core 50 to the top 46 and bottom 48 carbon fiber skins. The nomex honeycomb core 50 is comprised of individual honeycomb cells 50A, preferably, but not necessarily, of substantially uniform shape and size, as most clearly shown in the cut-away portion of FIG. 5. The outer skins 46 and 48 are comprised of substantially unidirectional carbon fibers bonded together with a phenolic or epoxy resin. The substantially unidirectional orientation of the carbon fibers is represented throughout the figures by the substantially parallel lines 46A (for top skin 46) and 48A (for bottom skin 48). In manufacture, the elements of the structure (shown in expanded form in FIG. 3 and in cross-section in FIG. 4) are pressed and heated to bond and cure the elements.

In a first specific embodiment of the invention, greatly increased performance over the prior art was achieved using standard "off the shelf" carbon-nomex-carbon sandwich panels available from the M. C. Gill Corporation, specifically under the trade designation GILLFAB 4109™. The product data supplied from M. C. Gill for the GILLFAB 4109™ product are listed in Table 1 below:

TABLE I

GILLFAB 4109 - MARCH 1991

| | | | |
|---|---|---|---|
| DESCRIPTION: | Gillfab 4109 is a low smoke flooring panel made from unidirectional carbon reinforced phenolic facings bonded to aramid honeycomb core. | | |
| APPLICATIONS: | Designed for use as flooring in cabin compartments of commercial aircraft. | | |
| FEATURES: | Facings can be modified for better impact and covered with a thin fiberglass layer to prevent galvanic corrosion.<br>Low Smoke evolution in a fire<br>Very light weight and stiff<br>Passes McDonnell Douglas rolling cart fatigue test (Type 1).<br>Service temperature range: Up to 180° F. | | |
| SPECIFICATIONS: | McDonnell Douglas Dwg. No. 7954400, Ty. 1 and 2.<br>British Aerospace BAER 3231, Gr. M & L<br>FAR 25.853a - fire resistance. | | |
| CONSTRUCTION: | | Ty1/GrM | Ty2/GrL |
| | Facings: Unidirectional carbon/phenolic. | .010 | .010 |
| | Core: ⅛" cell aramid honeycomb. | 8 pcf | 4 pcf |
| | Adhesive: Fire retardant modified epoxy. | .03 psf/.038 psf | .03 psf/.038 psf |
| AVAILABILITY: | Thickness: Per customer specification.<br>Size: Standard size is 48" × 144". Other sizes are available on request to up 6' × 14'. | | |
| STANDARD TOLERANCES: | Thickness: +/− .01"<br>Length and Width: +0.5', −0'<br>Warpage: .025 in./ft., max | | |
| SIMILAR GILL PRODUCTS: | product number | Differences | |
| | 4017 | S-2 glass reinforced epoxy facings give a higher impact resistance and lower cost, but a higher smoke evolution. | |
| | 4004 | S-2 glass reinforced phenolic facings make the panel lower in cost but not as stiff. | |
| | 4009 | Epoxy resin in place of phenolic, giving better mechanicals but higher smoke evolution. | |

The GILLFAB 4109™ product is manufactured in accordance with the process procedures described by M. C. Gill in the four-part article "Sandwich Panel Review," appearing in the quarterly magazine *The M. C. Gill Doorway*, Volume 28 (Nos. 1–3) published in 1991, and Volume 29 (No. 1), published in 1992, incorporated herein by reference. As explained in the *M. C. Gill Doorway*, Volume 28 (No. 1) published in 1991, at pages 6–10, and as readily determined from an inspection of the publicly available product, the standard GILLFAB 4109™ panel includes composite outer skins (or "facings") 46 and 48 that are each comprised of at least two individual layers or "cross plies" of resin-bonded, unidirectional carbon fibers (shown in FIG. 3 herein as 47/47A and 49/49A), which are formed together. The relative directions of unidirectional carbon fibers of each cross ply can be varied by customer request or design requirements. The GILLFAB 4109™ panel is typically available in large rectangular sheets, which are then cut for the specific size and shape of the required diaphragm for the loudspeaker system.

When the standard GILLFAB 4109™ sandwich panel was used to fabricate the flat-panel diaphragm 40 to loudspeaker system 38 of FIG. 2, greatly increased performance was obtained over both the prior art conical loudspeaker systems and the prior art flat-panel diaphragm systems employing aluminum honeycomb or polystyrene cores. However, certain characteristics of the GILLFAB 4109™ product are specific to the safety requirements of the aircraft industry, and even greater performance in the flat-panel loudspeaker system 38 of FIG. 2 can be obtained by employing modified configurations of the carbon-nomex-carbon sandwich panel that optimize the physical properties for loudspeaker applications.

Specifically, as indicated in the product specifications of Table I, to reduce smoke in the case of an airplane fire, the GILLFAB 4109™ product uses a low-smoke phenolic resin to construct the carbon fiber composite facings on skins 46 and 48. To prevent galvonic corrosion, the skins 46 and 48 are covered with a thin fiberglass layer (not shown in the figures). In addition, due to the severe environment of the aircraft and aerospace environment, the density of the carbon fibers 46A and 48A, along with the density of nomex core 50, are relatively high. To still further reduce smoke in case of fire, a fire retardant epoxy 52 is used to bond the nomex core 50 to the upper and lower skins 46 and 48. These factors are not critical in the design of the improved loudspeaker system 38 of FIG. 2, and the sandwich can be further modified to optimize loudspeaker performance or reduce cost.

Specifically, it was found that the fiberglass overlay of the GILLFAB 4109™ product could be eliminated to reduce weight, as galvonic corrosion is not a concern in the loudspeaker environment. In addition, a more rigid, lighter weight epoxy resin matrix could be substituted for the phenolic resin in formating the carbon fiber skins 46 and 48, as reduced smoke in the case of fire is likewise not a concern. It was also determined that the density (or number) of carbon fibers could be reduced beyond that used in the GILLFAB 4109™ product, to achieve still further weight reduction. Likewise, a lighter weight, non-fire resistant epoxy adhesive could be used to bond the honeycomb core 50 to the skins 46 and 48. The honeycomb core density and thickness of the core could likewise each be reduced, to further decrease weight. The above modifications to the standard GILLFAB 4109™ sandwich panel resulted in a diaphragm 40 that provides even further increased performance of the loudspeaker system 38 and exhibits even higher modulus to intensity ratios (E/p).

Figure 6:
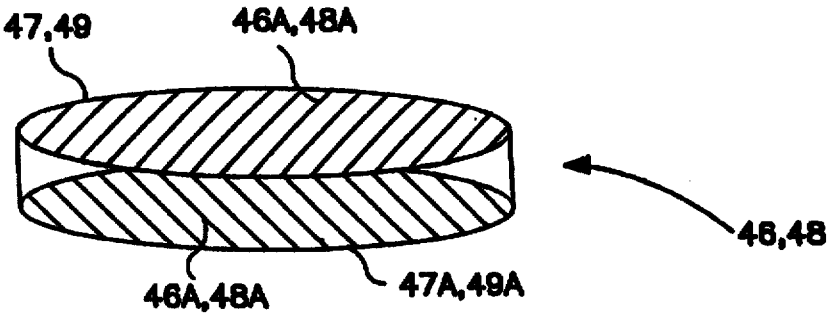
FIG. 6 is schematic representation depicting the unidirectional orientation of the carbon fibers forming each of the outer skins and the preferred relative out-of-phase relationship of the fiber orientations of the outer skins.

Moreover, in yet another preferred form, and referring additionally to FIG. 6, the diaphragm is fabricated with the orientation of the substantially unidirectional carbon fibers 46A/48A of the two layers or "cross plies" 47/47A and 49/49A of each outer skin 46/48 "out of phase" relative to each other. Although increased performance over the prior art is achieved without regard to the phase relationship of the carbon fibers 46A and 48A of each layer or cross ply of the outer skins, optimum performance is achieved as the out of phase relationship approaches ninety degrees, as shown most specifically in FIG. 6.

For example, in a preferred embodiment for a seven-inch diaphragm, optimal performance was obtained with carbon fiber skins 46 and 48 that comprise approximately 0.014-inch thick unidirectional carbon in an epoxy resin. The density of the carbon fiber in this embodiment is reduced by approximately 15% over the standard GILLFAB 4109™ panel. Likewise, in this embodiment, the nomex honeycomb core 50 is fabricated to be approximately 0.250 inches thick, with approximately 0.125 inch honeycomb cells, and having a density of approximately 1.8 pcf. The density of the epoxy adhesive used to bond the honeycomb core 50 to the skins 46 and 48 was reduced to approximately 0.031 psf over the standard GILLFAB 4109™ panel. The overall thickness of this embodiment of the diaphragm 40 is approximately 0.275 inches. The above configuration resulted in a high modulus, low density, high internal loss and overall light weight diaphragm 40, with increased loudspeaker performance as compared to the embodiment using the standard GILLFAB 4109™ sandwich panel. This specific form of the composite sandwich is now available from M. C. Gill for general applications under the designation GILLFAB 5209™.

Figure 7:
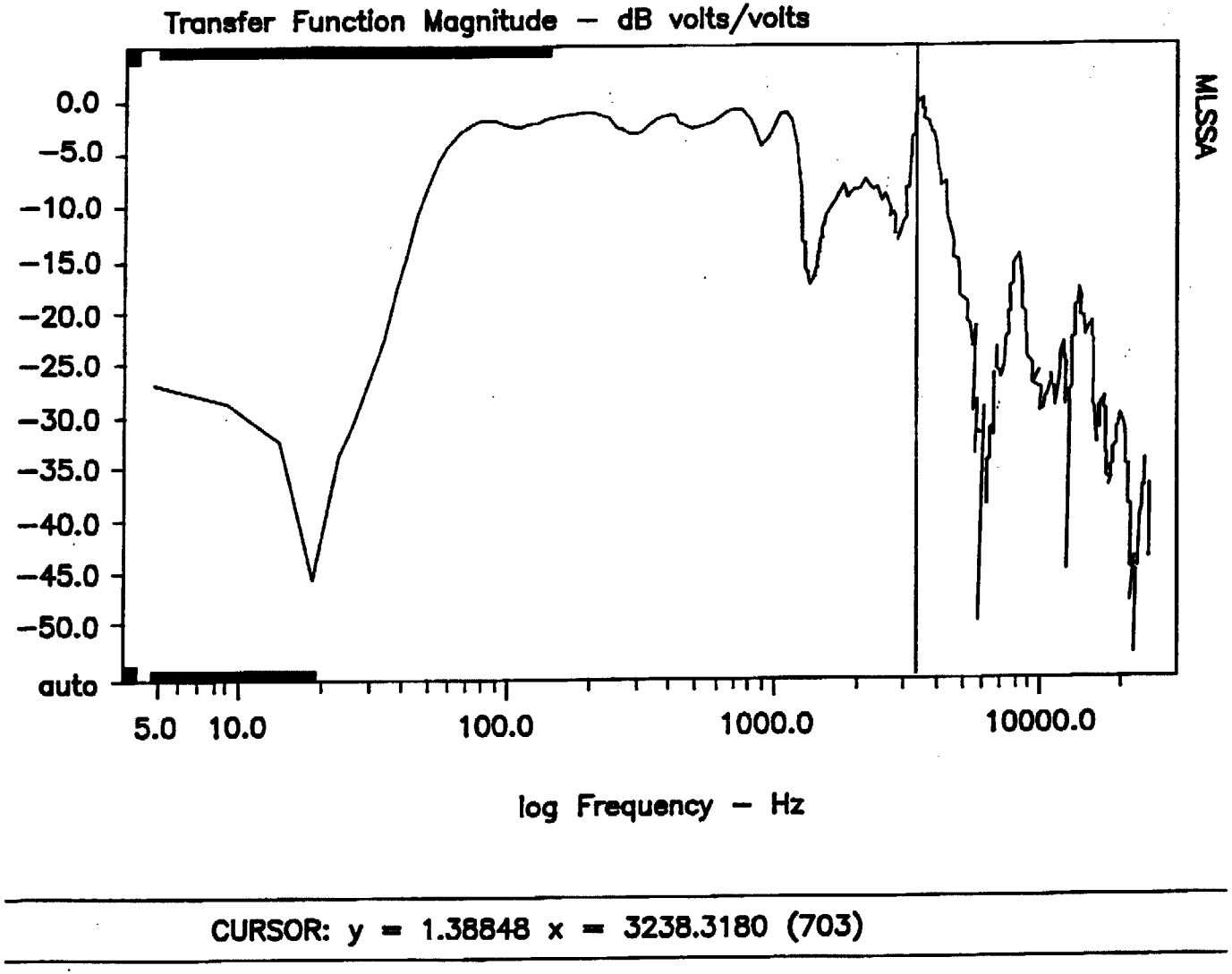
FIG. 7 is a frequency response plot for a ten inch loudspeaker system made in accordance with the present invention.

Shown in FIG. 7 is a frequency response graph for a ten-inch loudspeaker system in the configuration of FIG. 2, and employing the improved "carbon-nomex-carbon" flat-panel diaphragm of FIGS. 3 through 6. As can be seen, in the range of roughly 50 Hz to 1000 Hz, the frequency response curve is quite flat, and does not exhibit the distortion of prior art systems. The measurements in FIG. 7 were made with a microphone on axis at 50 cm distance with 1 watt of input power.

Thus, the recent advances in carbon-nomex-carbon honeycomb technology have resulted in sandwich structures used in other applications, such as the aircraft and aerospace industries and having desirable characteristics heretofore unrecognized for use as flat-panel diaphragms in loudspeaker systems. More specifically, carbon-nomex-carbon structures comprised of unidirectional carbon outer skins and low density aramid nomex honeycomb cores exhibit high modulus, low density and high internal loss. Further improvements are obtained by tailoring commercially available carbon-nomex-carbon panels used in aircraft to optimize characteristics specific to the loudspeaker environment. Particularly, lower density and higher modulus epoxy resins can be substituted for relatively less desirable fire-resistent phenolic resins. Likewise the density of the carbon fiber used in the outer skins can be reduced, as can the density of both the nomex honeycomb core and the epoxy used to bond the honeycomb to the carbon fiber skins. Further, the overall width of the carbon fiber skins and the nomex honeycomb core can be reduced. Additionally, by increasing the out-of-phase relationship between the cross plies of the outer unidirectional carbon fiber skins by roughly ninety degrees, further increases in modulus can be achieved. Each of the above changes even further increase performance.

It is believed that the improved flat-panel speaker diaphragm and resulting improved loudspeaker system of the present invention and many of their attendant advantages will be understood from the foregoing description, and it will be apparent that various changes may be made in the form, construction and arrangement of the parts without departing from the spirit or scope of the invention or sacrificing all of the material advantages, the forms hereinabove described being merely preferred or exemplary embodiments thereof.

We claim:

1. An audio speaker system for producing sound in response to varying audio signals, comprised of:

(a) a voice coil assembly including a voice coil that produces a varying coil current in response to the varying audio signals;

(b) a field structure that generates a magnetic field and that is operatively positioned relative to the voice coil so that the voice coil assembly is driven in a reciprocating piston motion corresponding to the varying coil current;

(c) a first suspension system coupled to and movably supporting the voice coil assembly in its reciprocating piston motion;

(d) a substantially flat diaphragm coupled to the voice coil assembly and driven in a reciprocating piston motion corresponding to the motion of the voice coil assembly, the diaphragm comprising:

(1) a lower carbon-reinforced skin, (2) an upper carbon-reinforced skin, and (3) an aramid honeycomb core having a density in the range of approximately 1.8 pcf and less than 4.0 pcf and bonded between the upper and lower skins with an epoxy adhesive, (e) a second suspension system coupled to and movably supporting the diaphragm in its reciprocating piston motion;

(f) a frame structure coupled to and supporting the first and second suspension systems and the field structure; and (g) wherein the upper and lower skins of the diaphragm each comprises a cross-ply including at least two plies having substantially unidirectional carbon filaments that have been dipped in an epoxy resin and are constructed with the direction of the carbon filaments of one ply substantially out of phase relative to the direction of the carbon filaments of a second ply.

2. The audio speaker of claim 1 wherein each skin of the diaphragm is constructed with the direction of the carbon filaments of one ply at an approximate right angle relative to the direction of the carbon filaments of a second ply.

3. The audio speaker of claim 1 wherein the aramid honeycomb core of the diaphragm is relatively thicker than the upper and lower skins and the epoxy adhesive has a density of approximately 0.031 psf.

4. The audio speaker of claim 1 wherein the aramid honeycomb core of the diaphragm has a density of approximately 1.8 pcf, is formed from Nomex and is comprised of an array of substantially uniform honeycomb cells that are approximately 0.125 inches in size, and wherein the upper and lower skins are each approximately 0.014 inches thick.

5. The audio speaker of claim 1 wherein:

(a) the aramid honeycomb core of the diaphragm is formed from Nomex and is comprised of an array of substantially uniform honeycomb cells of approximately 0.125 inches and has a density of approximately 1.8 pcf, and (b) the honeycomb core is bonded between the upper and lower skins with epoxy adhesive having a density of approximately 0.031 psf.

6. The audio speaker of claim 5 wherein the upper and lower skins are each approximately 0.014 inches thick.

7. The audio speaker of claim 5 wherein each skin of the diaphragm is constructed with the direction of the carbon filaments of one ply at an approximate right angle relative to the direction of the carbon filaments of a second ply.

8. A composite speaker diaphragm comprised of:

(a) a first substantially flat carbon fiber layer forming a first outer skin of the speaker diaphragm, (b) a second substantially flat carbon fiber layer forming a second outer skin of the speaker diaphragm, and (c) an aramid honeycomb core formed of an array of substantially uniform honeycomb cells and having a density in the range of approximately 1.8 pcf to less than 4 pcf, and wherein the honeycomb core is sandwiched between the first and second carbon layers to form a sandwich panel audio diaphragm, and (d) wherein each carbon fiber layer is comprised of at least two plies of primarily unidirectional carbon filaments bound together by an epoxy resin, and the primary direction of the carbon filaments of a first ply of the carbon fiber layer is substantially out of phase relative to the primary direction of the carbon filaments of a second ply of the carbon fiber layer.

9. The speaker diaphragm of claim 8 wherein the primary direction of the carbon filaments of a first ply of the carbon fiber layer is approximately ninety degrees out of phase relative to the primary direction of the carbon filaments of a second ply of the carbon fiber layer.

10. The speaker diaphragm of claim 9 wherein the first and second carbon layers are each approximately 0.014 inch thick.

11. The speaker diaphragm of claim 8 wherein the honeycomb core is comprised of nomex formed in an array of substantially uniform cells that are approximately 0.125 inches in size, and wherein the core has a density of approximately 1.8 pcf.

12. The speaker diaphragm of claim 11 wherein the honeycomb core is bounded between the first and second carbon layers with an epoxy adhesive having a density of approximately 0.031 psf.

13. A composite audio speaker diaphragm comprised of:

(a) a first carbon fiber layer forming a lower skin of the speaker diaphragm and including at least two plies of substantially unidirectional carbon filaments bound together by an epoxy resin, the direction of the carbon filaments of a first ply of the lower skin being substantially out of phase relative to the direction of a second ply of the lower skin, (b) a second carbon fiber layer forming an upper skin of the speaker diaphragm and including at least two plies of substantially unidirectional carbon filaments bound together by an epoxy resin, the direction of the carbon filaments of a first ply of the upper skin being substantially out of phase relative to the direction of a second ply of the upper skin, (c) an aramid honeycomb core sandwiched and bonded between the upper and lower skins, the honeycomb core having substantially uniform cells, and being relatively thicker than the carbon fiber layers, the core further having a density that falls between the range of approximately 1.8 pcf and less than 4.0 pcf.

14. A method of making a speaker diaphragm comprised of constructing a sandwich panel having outer facings with multiple plies of substantially unidirectional carbon filaments aligned at approximate right angles to each other and bound together in an epoxy resin and to a nomex honeycomb core with a density in the range of approximately 1.8 pcf to less than 4.0 pcf, and forming the speaker diaphragm from the sandwich panel.

15. The method of claim 14 wherein the sandwich panel is substantially flat, the core is approximately 0.250 inches thick, the density of the epoxy adhesive is approximately 0.031 psf, and the audio speaker diaphragm is formed at least in part by cutting the sandwich panel to a desired shape and size.

16. An audio speaker comprised of a sandwich panel speaker diaphragm including outer facings having substantially unidirectional carbon filaments in an epoxy resin, and an aramid honeycomb core bonded between the outer facings, and wherein the core is approximately 0.250 inches thick, has a density of between approximately 1.8 pcf and less than 4.0 pcf, and includes an array of substantially uniform honeycomb-shaped cells that are approximately 0.125 inches in size, and wherein each facing is comprised of multiple plies of unidirectional carbon filaments bound together with epoxy resin, and wherein for each facing, the direction of the carbon filaments of one ply is out of phase relative to the direction of the carbon filaments of another ply.

17. The speaker diaphragm of claim 16 wherein the aramid honeycomb core is comprised of nomex and is bonded to the outer facings with an epoxy adhesive having a density of about 0.031 psf.

18. A method of making a sandwich panel for use as a substantially flat speaker diaphragm, comprising:

(a) forming plies from unidirectional carbon fiber filaments that are dipped in an epoxy resin;

(b) forming outer skins by aligning at least two plies so that the unidirectional carbon fibers thereof are at approximate right angles to each other;

(c) forming an aramid honeycomb core that is approximately 0.250 inches thick, has a density between approximately 1.8 pcf and less that 4.0 pcf, and has an array of substantially uniform honeycomb cells that are approximately 0.125 inches in size;

(d) using an epoxy with a density of approximately 0.031 psf to bond the honeycomb core between outer skins to form a sandwich panel; and (e) cutting the panel to form a substantially flat speaker diaphragm of a desired shape.

19. A method of making sound with an audio speaker comprised of using a voice coil assembly to drive a substantially flat speaker diaphragm shaped from a sandwich panel having two outer facings each formed with multiple plies of low density unidirectional carbon filaments aligned at approximate right angles to each other in an epoxy resin and which are bonded to an aramid honeycomb core that is approximately 0.250 inches thick and has a density of approximately 1.8 pcf.

20. The speaker diaphragm of claim 13 wherein each carbon fiber layer comprises two plies formed together with the unidirectional carbon fiber filaments out of phase by approximately ninety degrees.

21. The speaker diaphragm of claim 20 wherein the density of the epoxy used to bond the core to the skins is approximately 0.031 psf.

22. An audio speaker system for producing sound in response to varying audio signals, comprised of:

(a) a voice coil assembly including a voice coil that produces a varying coil current in response to the varying audio signals;

(b) a field structure that generates a magnetic field and that is operatively positioned relative to the voice coil so that the voice coil assembly is driven in a reciprocating piston motion corresponding to the varying coil current;

(c) a first suspension system coupled to and movably supporting the voice coil assembly in its reciprocating piston motion;

(d) a substantially flat diaphragm coupled to the voice coil assembly and driven in a reciprocating piston motion corresponding to the motion of the voice coil assembly, the diaphragm comprising:

(1) a lower skin formed of at least two plies of substantially unidirectional carbon filaments in an epoxy resin and arranged so that the direction of the filaments of one ply are substantially out of phase relative to direction of the filaments of the other ply, (2) an upper skin formed of cross-plies of substantially unidirectional carbon filaments in an epoxy resin and arranged so that the direction of the filaments of one ply are substantially out of phase relative to direction of the filaments of the other ply, and (3) an aramid honeycomb core having a density less than 4.0 pcf and bonded between the upper and lower skins with an epoxy adhesive, (e) a second suspension system coupled to and movably supporting the diaphragm in its reciprocating piston motion;

(f) a frame structure coupled to and supporting the first and second suspension systems and the field structure.

23. A composite speaker diaphragm comprised of:

(a) a first substantially flat carbon fiber layer forming a first outer skin of the speaker diaphragm and including at least two plies of substantially unidirectional carbon filaments in an epoxy resin and arranged so that the direction of the filaments of one ply are substantially out of phase relative to direction of the filaments of the other ply, (b) a second substantially flat carbon fiber layer forming a second outer skin of the speaker diaphragm and including at least two plies of substantially unidirectional carbon filaments in an epoxy resin and arranged so that the direction of the filaments of one ply are substantially out of phase relative to direction of the filaments of the other ply, and (c) an aramid honeycomb core having a density between 1.8 pcf and less than 4.0 pcf, the core being sandwiched between the first and second carbon skins with an epoxy adhesive to form a sandwich panel audio diaphragm.

* * * * *

UNITED STATES PATENT AND TRADEMARK OFFICE

CERTIFICATE OF CORRECTION

PATENT NO : 5,701,359
DATED : December 23, 1997
INVENTOR(S) : Edward W. Guenther and Stephen Leigh It is certified that error appears in the above-identified patent and that said Letters Patent is hereby corrected as shown below:

On the title page, item [56], after "3,347,335 10/1967 Watters ..... 181/0.5" insert --4,122,314 10/78 Matsuda et al. 381/203--.

In the claims, in column 11, line 41 change "bounded" to --bonded--.

Signed and Sealed this

Twenty-third Day of June, 1998

*Attest:*

*Attesting Officer*

BRUCE LEHMAN

*Commissioner of Patents and Trademarks*